US005638612A

United States Patent [19]

Donzis

[11] Patent Number: 5,638,612

[45] Date of Patent: Jun. 17, 1997

[54] IMPACT ABSORBING SYSTEM FOR FOOTWEAR

[76] Inventor: Byron A. Donzis, #18 W. Rivercrest, Houston, Tex. 77042

[21] Appl. No.: 684,509

[22] Filed: Jul. 19, 1996

Related U.S. Application Data

[63] Continuation of Ser. No. 402,131, Mar. 10, 1995, abandoned.

[51] Int. Cl.[6] ..... A43B 13/20; A43B 7/06

[52] U.S. Cl. ..... 36/29; 36/3 R

[58] Field of Search ..... 36/29, 3 R, 3 A, 36/3 B, 153, 147

[56] References Cited

U.S. PATENT DOCUMENTS

| | | | |
|---|---|---|---|
| 4,361,969 | 12/1982 | Vermonet | 36/29 X |
| 4,446,634 | 5/1984 | Johnson et al. | 36/29 |
| 4,730,403 | 3/1988 | Walkhoff | 36/119 |
| 4,817,304 | 4/1989 | Parker et al. | 36/29 X |
| 4,999,932 | 3/1991 | Grim | 36/3 B X |
| 5,113,599 | 5/1992 | Cohen et al. | 36/29 X |
| 5,444,926 | 8/1995 | Allen et al. | 36/29 X |

FOREIGN PATENT DOCUMENTS

| | | | |
|---|---|---|---|
| 2424716 | 1/1980 | France | 36/3 R |
| 2321817 | 11/1973 | Germany . | |
| 0346339 | 2/1937 | Italy | 36/3 R |
| 9110376 | 7/1991 | WIPO | 36/29 |

*Primary Examiner*—Ted Kavanaugh

*Attorney, Agent, or Firm*—Sue Z. Shaper; Butler & Binion, L.L.P.

[57] ABSTRACT

An improved impact absorbing system for footwear including a compartment having a radiator structure attached to the footwear in fluid communication with an impact absorbing pad in the footwear for cooling the pad fluid heated by repeated compression, as the fluid circulates.

12 Claims, 3 Drawing Sheets

FIG. 2
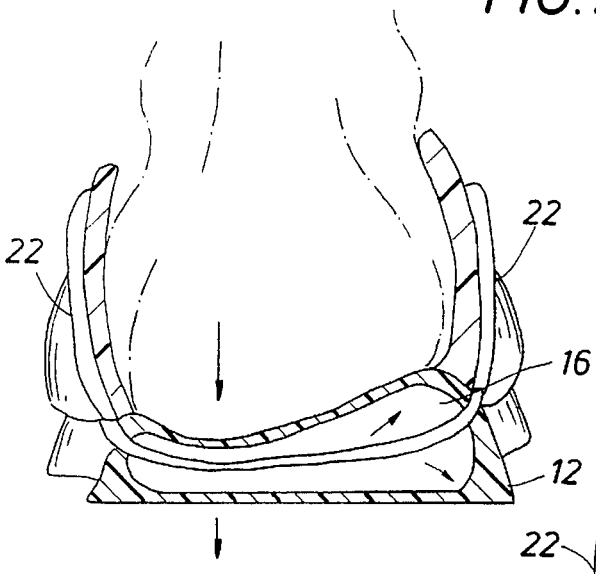
FIG. 4
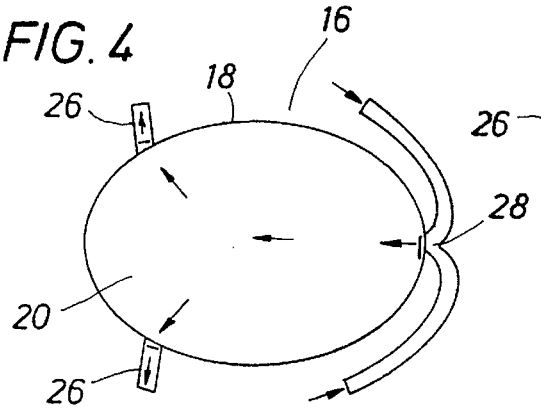
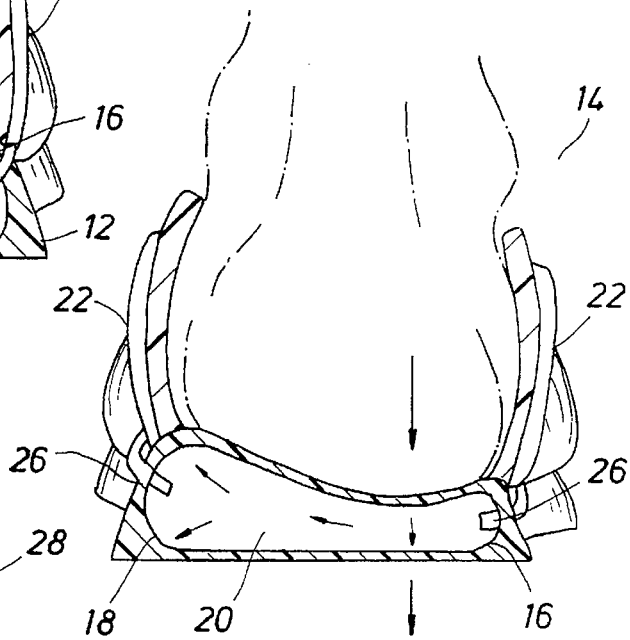
FIG. 3
FIG. 6
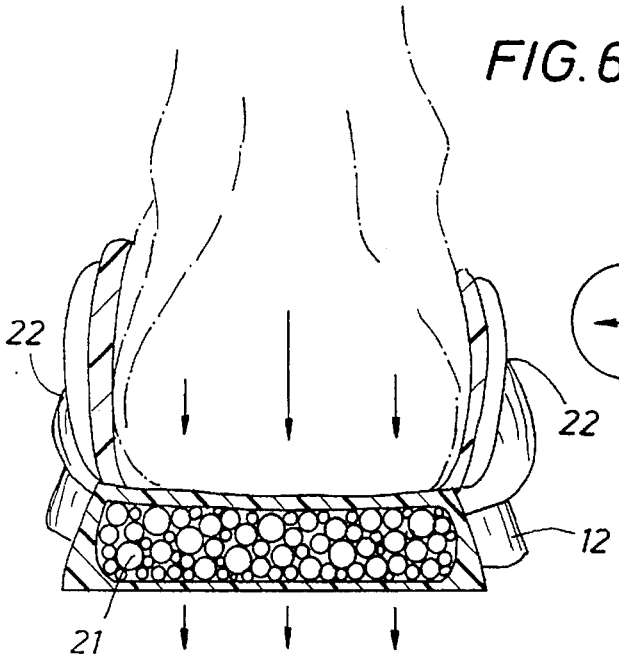
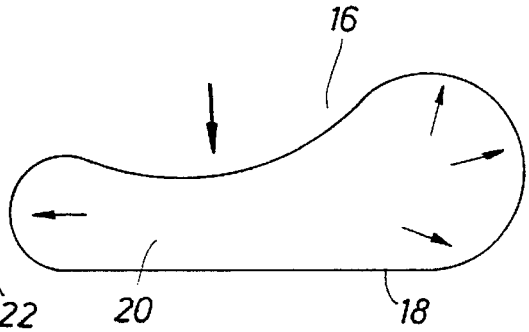
FIG. 5

FIG. 7
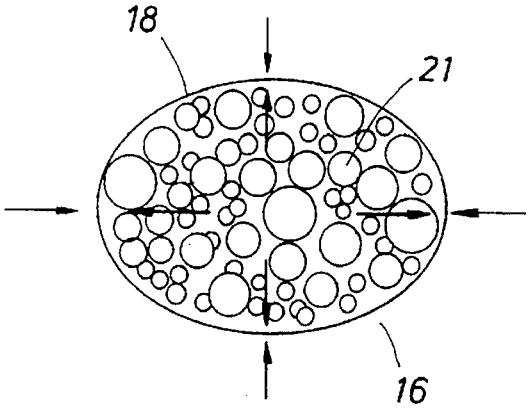
FIG. 8
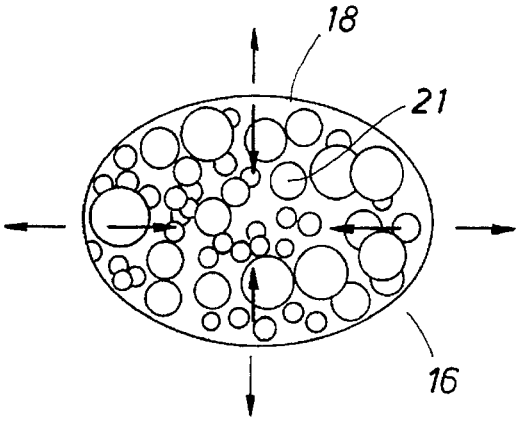
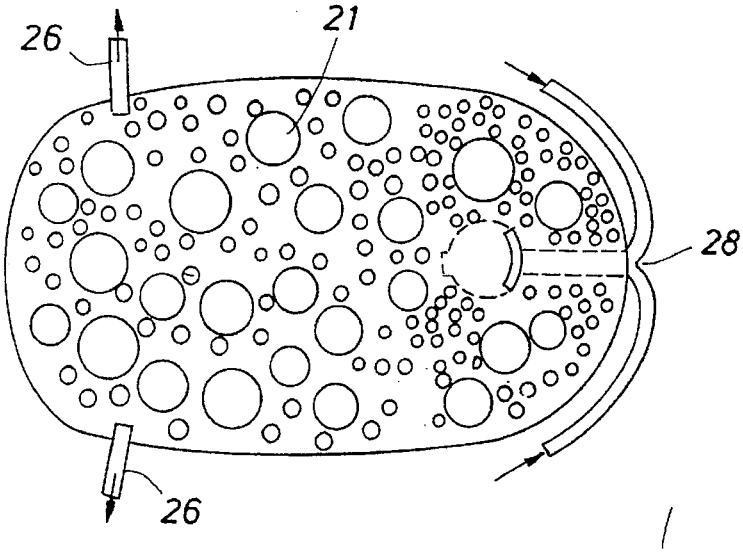
FIG. 9
FIG. 10
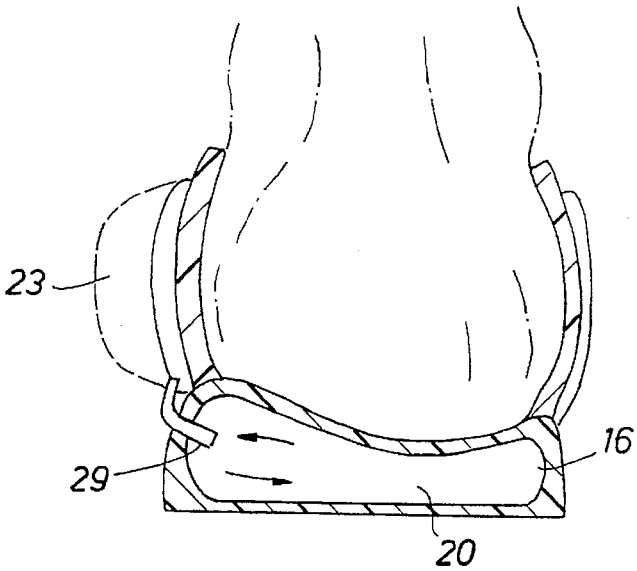

IMPACT ABSORBING SYSTEM FOR FOOTWEAR

This is a file-wrapper continuation of U.S. application Ser. No. 08/402,131 filed on Mar. 10, 1995 now abandoned.

BACKGROUND OF THE INVENTION

1. Field of the Invention

The subject invention is generally related to impact absorbing devices and is specifically related to an improved impact absorbing system for footwear including a compartment having a radiator structure in communication with an impact absorbing pad in the footwear for automatically cooling the pad as it becomes heated by frequent compression.

2. Description of the Prior Art

Impact absorbing devices in footwear are well known to absorb shock of foot strike to prevent injuries and provide comfortable footwear. In the past, various padding materials, such as foam rubber, foamed plastics, sponge rubber and the like, have been used as heel and foot sole pads in shoes to absorb and disperse the applied impact. However, these types of pads have the disadvantage that they often "bottom out" or fully compress and thus provide minimal impact absorption.

Impact absorbing pads which employ fluid filled bladders, such as air cushioning sacks, have been found to be effective shock absorbers and are widely used in footwear. These devices frequently rely upon the compressibility of the enclosed fluid to provide the desired shock absorbing. While effective as shock absorbers, one disadvantage of these devices is that frequent compression of the pads during typical use, such as jogging, heats the fluid enclosed within the pad. This causes the pad to become uncomfortably warm and may lead to discomfort and interfere with the wearer's performance or enjoyment of the activity. There is nothing in the prior art which sufficiently addresses this problem.

Therefore, there is a need for an improved impact absorbing system for footwear for cooling a fluid filled pad as it becomes heated by frequent compression, to prevent the pad from becoming uncomfortably warm.

SUMMARY OF THE INVENTION

The subject invention is directed to an improved impact absorbing system for footwear comprising an impact absorbing pad including a generally air impermeable flexible enclosure having a fluid in the enclosure. A compartment having a radiator structure including a second generally air impermeable enclosure is provided, along with a fluid communication means for communicating fluid between the pad and the compartment. The radiator structure is in contact with the atmosphere. The impact absorbing system is attached to a shoe and is specifically designed to allow the fluid, which has become heated by frequent compression of the pad, to be passed through the compartment for cooling the fluid to provide increased comfort to the wearer.

In preferred embodiments, the compartment has a radiator structure which includes a plurality of folds of the enclosure material across its surface to define a large surface area. By providing a large surface area for contacting the fluid, the radiator structure of the compartment disperses the heat and cools the fluid. The radiator compartment could comprise an expandable pocket designed to expand the contract as fluid flows into and out of the compartment in response to the compression of the impact absorbing pad. Preferably, means are provided to circulate fluid between the pad and the compartment.

The means for transferring the fluid between the impact absorbing pad and the compartment is preferably a tubular passageway. A single tube which allows the fluid to be transferred in either direction between the pad and the compartment may be used, or a pair or plurabily of tubes together with one-way valves may be used to circulate fluid in one direction.

In one preferred embodiment, the impact absorbing system includes a first and second compartment on either side of the shoe. The impact absorbing pad includes one or more one-way outlet valves for transferring fluid to the compartments, and one or more one-way inlet valves for receiving cooled fluid from the compartments. While this preferred embodiment includes two compartments in communication with a single pad, the subject invention may include any combination of compartments and pads which provide means for communicating the fluid in the pads between the pads and compartments for cooling the fluid.

Therefore, it is an object and feature of the subject invention to provide an improved impact absorbing system for footwear including a compartment in communication with an impact absorbing pad in the footwear for cooling the fluid filled pad as it becomes heated by frequent compression.

It is an additional object and feature of the subject invention to provide an improved impact absorbing system with a compartment having a radiator structure, an impact absorbing pad including a flexible enclosure and fluid in the enclosure and a means for communicating fluid between the pad and the compartment.

It is yet another object and feature of the subject invention to provide an improved impact absorbing system with a compartment having a radiator structure including a plurality of folds to define a surface area for contacting and cooling the fluid of the impact absorbing pad in the footwear.

It is a further object and feature of the subject invention to provide an improved impact absorbing system including a first and second compartment and one-way inlet and outlet valves for communicating fluid between the pad and the compartment.

Other objects and features will be readily apparent from the accompanying drawings and description.

BRIEF DESCRIPTION OF THE DRAWINGS

FIG. 2 is a partial cross-sectional view of the rear of the shoe including two impact absorbing pads having a flexible enclosure filled with air and in communication with compartments located on either side of the shoe.

FIG. 3 is a partial cross-sectional view of the rear of the shoe including a single impact absorbing pad filled with air and showing the release of the air through the either side of the shoe in response to the compression of the impact absorbing pad.

FIG. 4 is an overhead view of the impact absorbing pad filled with air and having a pair of one-way outlet valves and a one-way inlet valve for communicating the air between the pad and the compartment.

FIG. 5 is a side view of the compression of the impact absorbing pad filled with air.

FIG. 6 is a partial cross-sectional view of the rear of the shoe including an impact absorbing pads having a flexible enclosure filled with open-cell foam and in communication with sealed compartments located on either side of the shoe showing the open-cell foam in response to the compression of the pads.

FIG. 7 is a cross-sectional view showing the open cell foam within the flexible enclosure during compression.

FIG. 8 is a cross-sectional view showing the open cell foam within the flexible enclosure during expansion.

FIG. 9 is an enlarged overhead cross-sectional view of open cell foam in a flexible enclosure showing a pair of one-way outlet valves for passing fluid to the compartment and a one-way inlet valve for receiving fluid into the pad.

FIG. 10 is a partial cross-sectional view of the rear of the shoe including a single impact absorbing pad filled with fluid and in communication with an expandable pocket located on the side of the shoe.

DETAILED DESCRIPTION OF THE DRAWINGS

Figure 1:
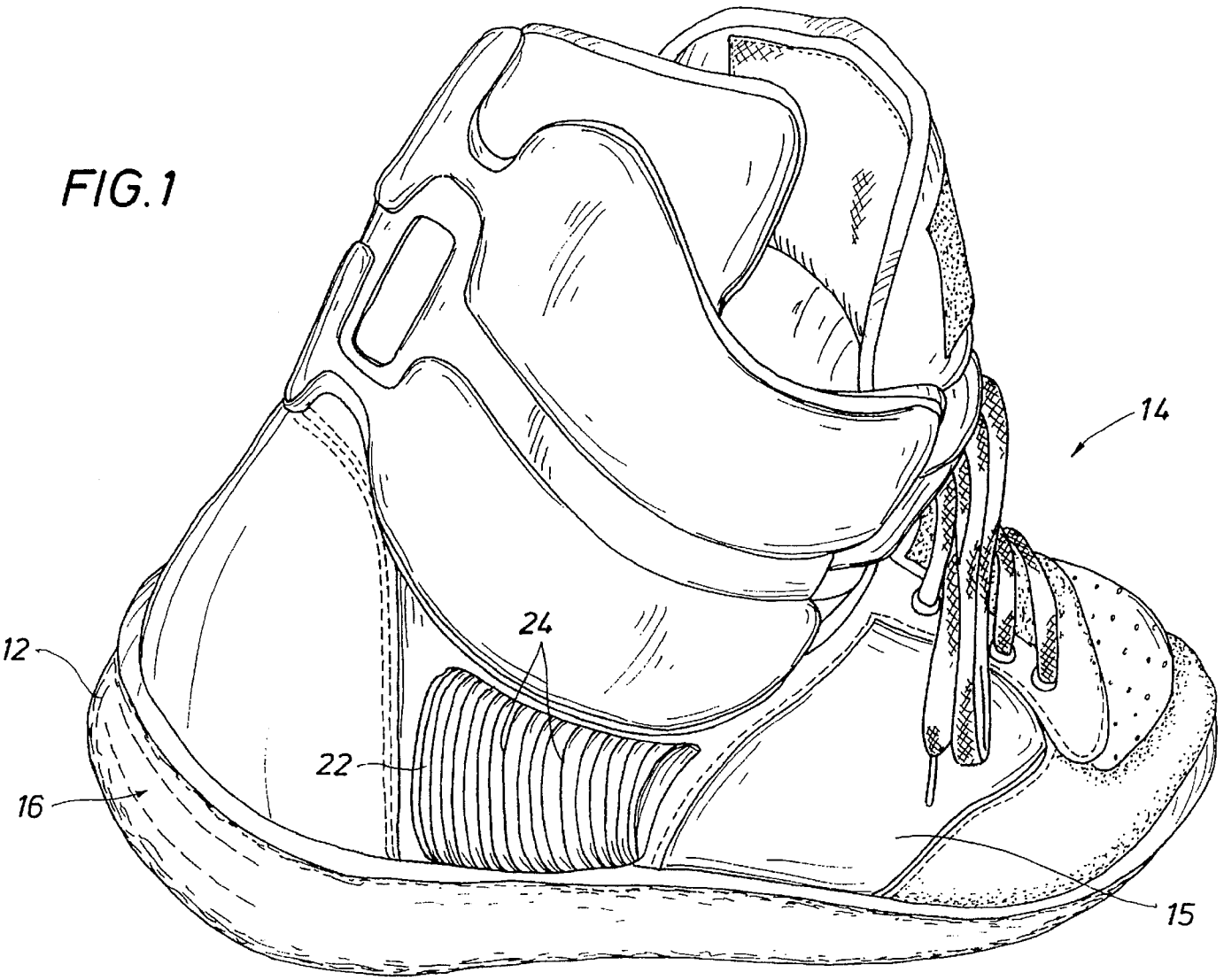
FIG. 1 is a perspective view of a shoe including the improved impact absorbing system and showing the generally impermeable compartment in contact with the atmosphere and attached to the side of the shoe.

Referring to the accompanying drawings, the improved impact absorbing system for footwear of the subject invention is designated generally by the numeral 14. The preferred embodiment of the improved impact absorbing system includes a sole 12 enclosing one or more impact absorbing pads 16 having a flexible enclosure 18 and a fluid 20 in the enclosure, a sealed compartment 22 having a radiator structure and a means for communicating the fluid 20 between the pad 16 and compartment 22. As shown in FIG. 1, the sealed compartment 22 is attached to the side of the shoe 15 for automatically cooling the impact absorbing pad in the shoe as it becomes heated by frequent compression.

While no pad enclosures are absolutely air impermeable, the flexible enclosure 18 of the pad 16 is essentially fluid-tight so that the fluid 20 within the pad does not escape through the enclosure 18. Likewise, the compartment 22 is constructed to provide a fluid-tight compartment. The fluid in the enclosure may be any suitable fluid but is more particularly air or nitrogen (as shown in FIGS. 2–5). The enclosure may also include an open cell foam 21 (as shown in FIGS. 6–9).

In the preferred embodiment, the sealed compartment 22 has a radiator structure which includes a plurality of folds 24 across its surface formed of the enclosure material to form fins and define a large surface to be contacted by the fluid entering the compartment for quickly dispersing the heat and cooling the fluid. Thus, the sealed compartments 22 serves as a "radiator" to cool the internal fluid of the pad 16. In an alternative embodiment shown in FIG. 10, the sealed compartment 22 comprises an expandable pocket 23 designed to expand and at least double in size and contract as the fluid flows into and out of the compartment in response to the compression of the impact absorbing pad of the footwear. A suitable radiator structure could take any one of many forms that provides a large exposure of enclosure surface areas to the atmosphere.

In one preferred embodiment, the means for transferring the fluid between the impact absorbing pad 16 and the compartment 22 comprises one-way valves. As best seen in FIGS. 3 and 9, the improved impact absorbing system 14 may include a pair of one-way outlet valves 26 and a one-way inlet valve 28 extending between the pad 16 and the compartment or compartments 22 to connect them in a circulatory fashion. In an alternative embodiment, a single tube 29, which allows the fluid to be transferred in either direction between the pad 16 and the compartment 22, could be used.

As shown in FIGS. 2, 3, 5 and 6, in operation, when the pad is compressed by an impact force, such as the force applied by the heel of the wearer's foot, the fluid within the pad is displaced within the flexible enclosure. Because the flexible enclosure is generally air impermeable, the fluid does not escape and heat is generated by the compressions of the fluid. Thus, while the compressibility of the fluid provides a desired shock absorbing affect, frequent compression during typical use causes the fluid to become significantly heated and the pad may become uncomfortably warm. The effects of compression on a flexible enclosure pad filled with air is shown in FIGS. 2–5. FIGS. 7 and 8 illustrate a pad having a flexible enclosure filled with an open cell foam and the forces of compression and expansion on such a pad.

In the preferred embodiment, the impact absorbing system includes a first and second compartment 22 on either side of the shoe 15. As best shown in FIGS. 4 and 9, the impact absorbing pad includes a pair of one-way outlet valves 26 for transferring fluid to the first and second compartments 22 upon compression of the pad and a single one-way inlet valve 28 for receiving cooled fluid from the compartments upon release and return of the pad to its uncompressed position. As shown, in response to the compression of the pad, the fluid 20 exits the enclosure 18 through outlet valves 26, is passed through the compartments 22 and returns from the compartments to the pad through inlet valve 28.

While the preferred embodiment includes a compartment on opposite sides of the shoe in communication with a single impact absorbing pad in the shoe, the improved impact absorbing system of the subject invention may include any combination of compartments and pads which provide means for communicating fluid in the pads between the pads and compartments for cooling fluid in response to frequent compression.

While specific embodiments and features of the invention have been disclosed herein, it will be readily understood that the invention encompasses all enhancements and modifications within the scope and spirit of the following claims.

What is claimed is:

1. An improved impact absorbing system in combination with footwear, said combination comprising:

a pad attached to a shoe such that the pad absorbs impact during shoe use, said pad including a first generally air impermeable enclosure;

a compartment having a radiator structure including a second generally air impermeable enclosure, the radiator structure comprising a plurality of folds across its surface forming a plurality of fins fashioned from enclosure material and defining a large heat transfer surface area, said compartment being attached to an upper of said shoe such that the plurality of fins contacts the outer atmosphere as the pad absorbs impact during use; and means for fluid communication between the first pad enclosure and the second compartment enclosure.

2. An improved impact absorbing system for footwear comprising:

a pad attached to a shoe such that the pad absorbs impact during shoe use, said pad including a first generally air impermeable enclosure;

a compartment having an expandable pocket structure defining a second generally air impermeable enclosure, said expandable pocket structure comprising at least partially expandable enclosure material and defining a large heat transfer surface area, said compartment being attached to an upper of said shoe such that the expandable pocket structure at least double in size and contacts the outer atmosphere as the pad absorbs impact during use; and means for fluid communication between the first pad enclosure and the second compartment enclosure.

3. The system of claims 1 or 2 wherein the means for fluid communication maintains pad fluid pressure and compartment fluid pressure equalized.

4. The system of claims 1 or 2 wherein the means for fluid communication includes means for causing fluid to communicate from the pad to the compartment upon in the pad impact.

5. The system of claims 1 or 2 wherein the pad includes a fluid inlet port and a fluid outlet port and wherein the means for fluid communication includes means for causing fluid to enter the pad through the inlet port and to exit the pad through the outlet port.

6. The system of claims 1 or 2 wherein the means for fluid communication includes a plurality of tubular passageways attached between the pad and the compartment and a plurality of one-way valves attached to said passageways for controlling fluid communications such that fluid is circulated between the compartment and the pad so that fluid moves in only one direction through each passageway.

7. The system of claims 1 or 2 including a plurality of compartments in fluid communication with the pad.

8. An improved method for absorbing impact in footwear, comprising:

absorbing impact from shoe use with a pad attached to a shoe;

and upon impact absorption, communicating fluid from the pad to a compartment attached to an upper of the shoe, said compartment having a radiator structure comprising a plurality of folds across its surface forming a plurality of fins defining a large heat transfer surface area that contacts the outer atmosphere.

9. An improved method for absorbing impact in footwear comprising:

absorbing impact from shoe use with a pad attached to the shoe; and upon impact absorption, communicating fluid from the pad to a compartment attached to an upper of the shoe, said compartment having an expandable pocket structure comprising at least partially expandable enclosure material which at least double in size and contact the outer atmosphere defining a large heat transfer surface area.

10. The method of claims 8 or 9 wherein the communicating equalizer fluid pressure in the pad and the compartment.

11. The method of claims 8 or 9 wherein the communicating includes communicating fluid from the pad to the compartment upon absorbing impact.

12. The method of claims 8 or 9 wherein the communicating includes circulating fluid through a first passageway from the pad to the compartment and circulating fluid through a second passageway from the compartment to the pad.

* * * * *